US010995988B2

(12) United States Patent
Jian et al.

(10) Patent No.: US 10,995,988 B2
(45) Date of Patent: May 4, 2021

(54) BALANCED DRYING SYSTEM

(71) Applicant: VERBOCA ENERGY-SAVING TECHNOLOGIES CO., LTD, Guangdong (CN)

(72) Inventors: Su Jian, Guangdong (CN); Yuanmin Duan, Guangdong (CN)

(73) Assignee: VERBOCA ENERGY-SAVING TECHNOLOGIES CO., LTD, Foshan (CN)

( * ) Notice: Subject to any disclaimer, the term of this patent is extended or adjusted under 35 U.S.C. 154(b) by 237 days.

(21) Appl. No.: 16/063,243

(22) PCT Filed: Dec. 21, 2015

(86) PCT No.: PCT/CN2015/098133
§ 371 (c)(1),
(2) Date: Jun. 15, 2018

(87) PCT Pub. No.: WO2017/107022
PCT Pub. Date: Jun. 29, 2017

(65) Prior Publication Data

US 2018/0372407 A1 Dec. 27, 2018

(51) Int. Cl.
*F26B 9/06* (2006.01)
*F26B 25/00* (2006.01)
(Continued)

(52) U.S. Cl.
CPC ..... *F26B 9/063* (2013.01); *F26B 9/06* (2013.01); *F26B 21/00* (2013.01); *F26B 21/001* (2013.01);
(Continued)

(58) Field of Classification Search
CPC ..... F26B 21/00; F26B 21/001; F26B 21/003; F26B 21/006; F26B 21/04; F26B 25/00;
(Continued)

(56) References Cited

U.S. PATENT DOCUMENTS 3,813,039 A * 5/1974 Wells ..... F28D 21/0008 237/55
3,849,904 A * 11/1974 Villalobos ..... F26B 23/002 34/636
(Continued)

FOREIGN PATENT DOCUMENTS

CN 103245185 B 11/2014
DE 19735322 A1 * 2/1999 ..... F26B 23/022
(Continued)

OTHER PUBLICATIONS

International Search Report of PCT Patent Application No. PCT/CN2015/098133 dated Oct. 9, 2016.

*Primary Examiner* — Jorge A Pereiro
*Assistant Examiner* — Logan P Jones

(57) ABSTRACT

The invention provides a balanced drying system, comprising an air supply and exhaust main pipeline, and at least two groups of drying units; the drying units each comprises a unit air supply fan and a drying oven, the drying units each is provided with a unit air inlet and a unit air outlet, the drying oven is provided with a drying oven air inlet and a drying oven air outlet, and all of the groups of the drying units are disposed in pairs at intervals on the air supply and exhaust main pipeline via the unit air inlet and the unit air outlet, the unit air inlet is connected with the drying oven air inlet, and the unit air outlet is connected with the drying oven air outlet. The invention has the advantages of concise and stable system, simple adjustment, low exhaust air volume, low energy consumption and the like.

7 Claims, 2 Drawing Sheets

(51) Int. Cl.
*F26B 21/00* (2006.01)
*F26B 3/04* (2006.01)
*F26B 21/04* (2006.01)

(52) U.S. Cl.
CPC ..... *F26B 21/003* (2013.01); *F26B 25/00* (2013.01); *F26B 25/007* (2013.01); *F26B 21/006* (2013.01)

(58) Field of Classification Search
CPC .. F26B 25/007; F26B 3/04; F26B 9/06; F26B 9/063
See application file for complete search history.

(56) References Cited

U.S. PATENT DOCUMENTS 4,043,051 A * 8/1977 Lussenden ..... F26B 21/086 34/77
4,291,472 A * 9/1981 Lewis ..... F26B 21/02 34/212
4,299,036 A * 11/1981 Schregenberger ..... F27B 9/28 34/210
4,624,109 A * 11/1986 Minovitch ..... F01K 25/10 60/648
5,483,754 A * 1/1996 Gresens ..... F26B 21/04 34/478
6,735,882 B2 * 5/2004 Takahashi ..... F26B 13/10 34/212
2015/0121720 A1 * 5/2015 Wieland ..... F26B 21/10 34/493
2018/0274859 A1 * 9/2018 Hack ..... F26B 23/002

FOREIGN PATENT DOCUMENTS

DE 102008034746 A1 * 2/2010 ..... F26B 23/022
DE 202011001491 U1 * 3/2011 ..... F26B 21/00
EP 2633922 A1 9/2013
EP 2738501 A2 * 6/2014 ..... F26B 23/002
EP 2924381 A1 * 9/2015 ..... F26B 25/008
EP 2952843 A1 * 12/2015 ..... F23G 7/066
WO WO-2009059749 A2 * 5/2009 ..... F26B 23/022

* cited by examiner

BALANCED DRYING SYSTEM

FIELD OF THE INVENTION

The invention relates to the field of energy conservation and emission reduction, and relates to a multi-unit hot air drying process in packaging printing, coating and painting industries, particularly, relates to production equipments of that require hot air drying, such as a gravure printing machine, a laminating machine, a coating machine, and furniture painting.

BACKGROUND OF THE INVENTION

Drying system is the main energy consumption unit for printing, laminating, coating, spraying and paint spraying equipments. It is also the main emission source of exhaust air. The performance of the drying system is the core parameter of performance evaluation indicators of the production equipment.

At present, the drying system of most production equipments does not have a very good automatic control function. When operating, the operating status of the drying system needs to be manually adjusted by the operators based on their practical experience. The air supply and exhaust of the drying oven are roughly adjusted by manual air valves. The adjustment of the multiple air valves also requires highly for the skill of the operator and it is difficult to timely and effectively control the air volume according to actual drying requirements. If the air exhaust is insufficient, safety accidents or product quality accidents may easily occur. For insurance purpose, the amount of air that is regulated is often much greater than the reasonable demand. Excess hot exhaust air is discharged into the air, causing energy waste and air pollution that is difficult to control.

Domestic equipment manufacturers in this field have also made some improvements to the design of the drying oven structure and internal return air utilization, which has optimized the performance of the drying system to a certain extent. However, the results are still not satisfactory, and there is still great room for improvement of the drying system in terms of energy saving and emission reduction. In addition, when products that contain organic solvent are dried, the air volume of each unit is separately and variously adjusted, resulting in different organic solvent concentration in each unit. For the sake of safety, it is necessary for the multi-unit drying system with automatic control function to be provided in each unit with VOC gas concentration monitors, leading to complex systems, poor reliability and large investment.

Traditional Drying System:

On the one hand, most of air supply of the drying oven is provided so that air is directly sucked from the production site by the unit's independent air inlet. Dust and humidity increase due to weather changes or workshop hygiene and cleaning, which will affect the production process and the quality of finished products. In some cases, centralized air supply after dust removal and humidity control (i.e., multi-unit parallel air suction) is performed, which solves the problem of cleanness and humidity fluctuations of the supplied air, but the air supply of each unit depends on adjustment of the opening of the air valve to balance the air pressure difference between various suction inlets to adjust the air flow required by each unit. In addition, for the multi-unit parallel air exhaust, it is necessary to adjust the air exhaust valve to balance the air pressure at the air outlet of each unit, so as to achieve the air exhaust demand of several drying units. However, because the air exhaust is a multi-point regulation which would have mutual influence, the air pressure difference between each point of the system is relatively large, will easily cause leakage of exhaust air of drying oven. The smaller the circulating air volume of the drying unit is, the more difficult it is to adjust the balance. Therefore, it is necessary to increase exhaust air volume to ensure reduced leakage of the drying oven. In addition, this needs only repeated manual adjustments based on hand feeling, which is tedious and difficult to cope with. Lack of experience will lead to the dilemma of poorer situation by more adjustments. Therefore, in the actual production, fine adjustment usually is not performed by production operators via valves. In order to meet requirements of most of the processes, the air volume is generally adjusted to be relatively larger. Taking the gravure printing machine as an example, the actual running air volume is often nearly 10 times that of the conservatively calculated safe air volume, which greatly increases the heating energy consumption and the fan operating power. At the same time, the increase of the exhaust air volume also increases the input and operation costs of the subsequent exhaust air treatment.

On the other hand, taking the printing machine as an example, the drying system comprises multiple units each having its own inlet and outlet, and the system has many air exhaust points. In order to ensure safe production, it is necessary to set concentration monitor at the air outlet of each unit of the entire system. This imposes higher degree of difficulty for user's operation and achievement of target detection. Usually, the user increases the amount of drying air based on experience to ensure that the solvent concentration is a safe concentration. However, the consumption energy of the drying oven becomes larger. In order to reduce energy consumption, the system is equipped with an inner-circulation air compensation line to form a structure in which a fresh air inlet and an inner-circulation air inlet are connected in parallel. When the amount of solvent used in the unit printing is large or the return air ratio is large, even if the total exhaust air volume is great, the unit exhaust air volume may still be insufficient. There may be a case where the solvent concentration in the dry air exceeds the lower safety limit, and there is a safety risk of explosion.

To sum up, the traditional drying system has the following problems: difficulty in system matching and adjustment, excessive exhaust air volume, excessive heating energy consumption, potential safety hazards, and great environmental protection cost.

SUMMARY OF THE INVENTION

The technical problem to be solved by the present invention is to provide a balanced drying system, which can fundamentally achieve the purpose of energy conservation and emission reduction, and at the same time effectively solve the problems of system matching and adjustment, excessive exhaust air volume, excessive heating energy consumption, potential safety hazards, and great environmental protection cost present in the conventional drying system.

In order to solve the above technical problems, the present invention provides a balanced drying system, which comprises an air supply and exhaust main pipeline, an air exhaust fan and at least two groups of drying units;

the drying units each comprises a unit air supply fan and a drying oven, the drying units each is provided with a unit air inlet and a unit air outlet, the drying oven is provided with a drying oven air inlet and a drying oven air outlet, and all of the groups of the drying units are disposed in pairs at intervals on the air supply and exhaust main pipeline via the unit air inlet and the unit air outlet, the unit air inlet is connected with the drying oven air inlet, and the unit air outlet is connected with the drying oven air outlet;

one end of the air supply and exhaust main pipeline is an air exhaust end and is connected with the air exhaust fan, the other end of the air supply and exhaust main pipeline is an air supply end, the unit air inlet of a first group of drying units is adjacent to the air supply end provided at the air supply and exhaust main pipeline, the unit air outlet of a last group of the drying units is adjacent to the air exhaust end provided at the air supply and exhaust main pipeline, and among the two adjacent groups of drying units, the unit air outlet of a former group of drying units is connected with the unit air inlet of a latter group of drying units;

the unit air supply fan is disposed between the unit air inlet and the drying oven air inlet.

Preferably, the distance between the unit air inlet and the unit air outlet of the same group of drying units is greater than the distance between the adjacent two groups of drying units.

Preferably, a partition plate is provided in the air supply and exhaust main pipeline between the unit air inlet and the unit air outlet of the same group of drying units.

Preferably, a valve is provided between the unit air outlet and the drying oven air outlet.

Preferably, a valve is provided between the unit air inlet and the drying oven air inlet.

Preferably, a concentration detection device is provided at the unit air outlet of the last group of drying units.

Preferably, the drying unit comprises a heater, the heater being disposed on a positive air pressure side or a negative air pressure side of the unit air supply fan.

Preferably, the balanced drying system further comprises an air supply filter, the air supply filter being disposed at the air supply end of the air supply and exhaust main pipeline.

Preferably, the balanced drying system further comprises an air supply fan and at least two air collection slots, wherein the air supply end of the air supply and exhaust main pipeline is provided with a plurality of air supply inlets connected in parallel and each corresponding to one group of drying units, the air collection slots are disposed at the air supply inlets and each is located under one of the drying ovens correspondingly, and the air supply fan and the air supply filter are all arranged at the collection pipe section at one side of an air outlet of the air supply and exhaust main pipeline.

Preferably, the balanced drying system further comprises a hot air main pipeline, an air supply fan, a hot air stove, an air supply filter and at least two hot air valves; the hot air main pipeline is provided with a plurality of hot air outlets each corresponding to one group of drying units, the hot air outlets each is connected with the unit air inlet, the hot air valves each is disposed between the hot air outlet and the unit air inlet, and the air supply fan, the hot air stove and the air supply filter are all arranged at the collection pipe section at one side of a hot air inlet of the hot air main pipeline.

A Balanced Drying System Embodying the Present Invention has the Following Beneficial Effects Compared to the Prior Art:

The unit air inlet and the unit air outlet of the drying unit of the balanced drying system of the present invention are all connected with the air supply and exhaust main pipeline, so that the unit air inlets of the drying units are connected with the unit air outlets of the adjacent drying units via the air supply and exhaust main pipeline to form a series connection structure. The equipment pipeline is simplified, and the air pressure in the drying oven is automatically balanced in the air supply and exhaust main pipeline. The adjustment is simple, and the air volume required by the drying system is successively entered in each drying oven for drying and sweeping of the material to be dried. The air volume is adjusted according to the safe solvent concentration of the drying system. The unit air volume adjustment is simple and does not affect other units. The air and the contained heat are directly reused until the final drying unit is discharged from the drying system, and thus the heating energy consumption is reduced to a minimum level. In addition, the exhaust air emission volume determines the exhaust air volume to be subsequently treated. The balanced drying system makes the input and operating costs of subsequent exhaust air treatment significantly reduced. The exhaust air concentration at the air outlet of the last group of drying unit passed by the drying air of the system is the highest concentration point of the entire drying system. The single point online monitoring is implemented at the highest exhaust air concentration point, so that enterprises can easily implement the entire process control of production. The air exhaust volume of the drying system is adjusted according to the exhaust air concentration so as to ensure the exhaust air concentration is below the safety limit, and thus the situation of the entire dry system is safe as long as the situation of a point is safe, which completely eliminates explosion hazard of the production equipment. Therefore, the present invention has the advantages of a simple and stable system, simple adjustment, low air exhaust volume and thus low energy consumption, no safety hazards, low environmental protection cost and the like.

The balanced drying system of the present invention can improve the current development difficulties of high energy consumption, high cost of waste gas treatment and potential safety hazards faced by industries such as packaging printing and coating and painting, fundamentally reduce production costs, completely eliminates explosion hazard of the production equipment, and achieved complete energy conservation and emission reduction. In the current severe environmental protection dilemma, it completely solves the problem that the enterprise's market competitiveness is not strong or even affects the survival of enterprises. It greatly facilities the development of packaging printing and coating and painting industries.

BRIEF DESCRIPTION OF THE DRAWINGS

In order to more clearly illustrate the technical solutions of the embodiments of the present invention, the drawings of the embodiments will be briefly described below.

DETAILED DESCRIPTION OF ILLUSTRATED EMBODIMENTS

The technical solutions in the embodiments of the present invention will be described in the following clearly and completely with reference to the accompanying drawings in the embodiments of the present invention. Apparently, the described embodiments are merely some but not all of the embodiments of the present invention. Based on the embodiments of the present invention, all other embodiments obtained by a person of ordinary skill in the art without creative efforts shall fall within the protection scope of the present invention.

Figure 1:
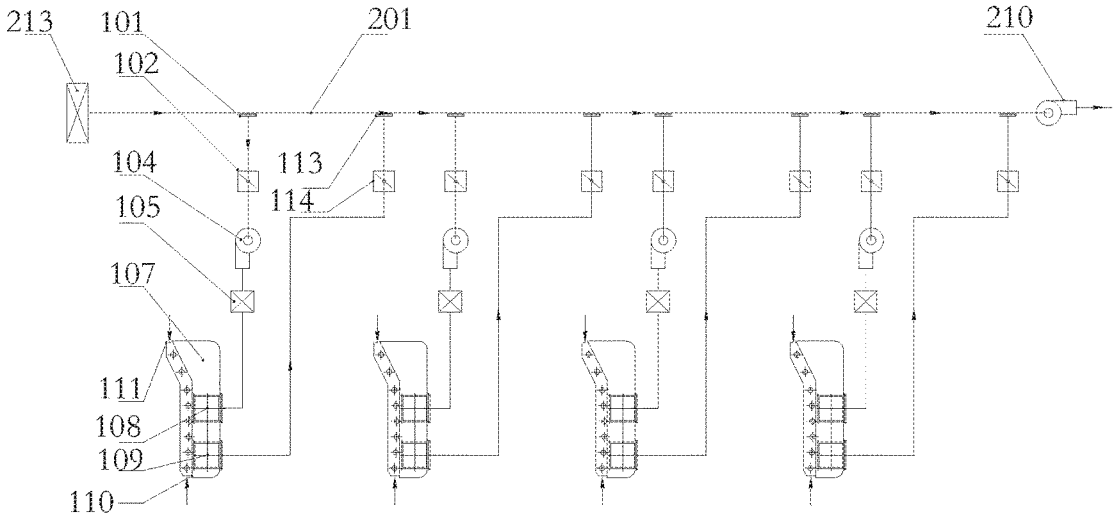
FIG. 1 is a schematic diagram of a balanced drying system according to the present invention.

Embodiment 1 taking a gravure printing machine as an example, referring to FIG. 1, the balanced drying system is described as follows.

The balanced drying system of this embodiment comprises an air supply and exhaust main pipeline 201, an air exhaust fan 210, and at least two groups of drying units. The drying units each comprises a unit air supply fan 104 and a drying oven 107, the drying units each is provided with a unit air inlet 101 and a unit air outlet 113, the drying oven 107 is provided with a drying oven air inlet 108 and a drying oven air outlet 109, and all of the groups of the drying units are disposed in pairs at intervals on the air supply and exhaust main pipeline 201 via the unit air inlet 101 and the unit air outlet 113, the unit air inlet 101 is connected with the drying oven air inlet 108, and the unit air outlet 113 is connected with the drying oven air outlet 109. One end of the air supply and exhaust main pipeline 201 is an air exhaust end and is connected with the air exhaust fan 210, the other end of the air supply and exhaust main pipeline 201 is an air supply end, the unit air inlet 101 of a first group of drying units is adjacent to the air supply end provided at the air supply and exhaust main pipeline 201, the unit air outlet 113 of a last group of the drying units is adjacent to the air exhaust end provided at the air supply and exhaust main pipeline 201, and among the two adjacent groups of drying units, the unit air outlet 113 of a former group of drying units is connected with the unit air inlet 101 of a latter group of drying units on the air supply and exhaust main pipeline 201. The unit air supply fan 104 is disposed between the unit air inlet 101 and the drying oven air inlet 108.

During the operation of the drying system, the unit air supply fan 104 and the air exhaust fan 210 of at least two groups of the drying units intake the air in the air supply and exhaust main pipeline 201 to make the air pressure in the air supply and exhaust main pipeline 201 lower than the ambient atmospheric pressure and the air pressure at the air exhaust end of the air supply and exhaust main pipeline 201 lower than that of the air supply end, so that the air flows from the air supply end to the air exhaust end. The unit air supply fan 104 of the drying unit draws gas from the unit air inlet 101 of the drying unit and sends the air through the drying oven air inlet 108 to drying oven 107. Before the air is sent to the drying oven 107, it should be heated to the temperature required by the drying unit process. The air sent to the drying oven 107 through the drying oven air inlet 108 and having swept the material to be dried and the air entering the drying oven 107 via the drying oven feed port, the drying oven discharge port and other leaking points pass through the drying oven air outlet 109 and the unit air outlet 113 of the drying unit under the drawing force of the low pressure within the air supply and exhaust main pipeline 201 and return back to the air supply and exhaust main pipeline 201, and finally flow towards the air exhaust end of the air supply and exhaust main pipeline 201. At this time, most of the air that is returned to the air supply and exhaust main pipeline 201 through the unit air outlet 113 of the drying unit is sucked by the unit air supply fan 104 of the latter group of drying units from the unit air inlet 101 of the latter group of drying units and is sent to the drying oven 107 via the drying oven air inlet 108. It flows through the drying oven 107 in each of the subsequent groups of drying units in turn, the concentration is increased step by step, and is finally discharged through the unit air outlet 113 of the last group of drying units. The air and the heat contained therein are directly reused. The small portion of the air returned to the air supply and exhaust main pipeline 201 through the unit air outlet 113 of the drying unit flows back to the unit air inlet 101 of the drying unit and is again sucked by the unit air supply fan 104 of the group of drying units and is sent to the drying oven 107 for reuse. This can maintain the air volume of the drying system constant while satisfying the process requirements of the drying air volume of the drying oven 107 for sweeping the material to be dried, and the effect of balancing the air pressure can be achieved.

It should be noted that, the drying oven 107 is provided with a drying oven air inlet 110 and a drying oven air outlet 111. The material to be dried enters the drying oven 107 from the drying oven air inlet 110 and leaves the drying oven 107 from the drying oven air outlet 111. The flow direction of the balanced drying system of the present invention may be in the same direction as the running direction of the material to be dried, and may also be reversed. For the drying effect of the material, the reverse flow direction is better than the same flow direction. The air supply end of the air supply and exhaust main pipeline 201 communicates with the outside air or other air supply equipment, and the air exhaust end of the air supply and exhaust air main pipeline 201 communicates with the outside air or other exhaust air treatment equipment.

More preferably, in order that the air sucked from the unit air inlet 101 by the unit air supply fan 104 of the drying unit preferably comes from the air supply end of the air supply and exhaust main pipeline 201, and that the air entering the air supply and exhaust main pipeline 201 is preferably sent to the air exhaust end of the air supply and exhaust main pipeline 201, there are at least two specific configurations: in the first configuration, the distance between the unit air inlet 101 and the unit air outlet 113 of the same group of drying units is greater than the distance between the adjacent two groups of drying units (i.e., the distance between the unit air outlet 113 of the former group of drying units and the air inlet 101 of the latter group of units); in the second configuration, a partition plate is provided in the air supply and exhaust main pipeline 201 between the unit air inlet 101 and the unit air outlet 113 of the same group of drying units (not shown in the drawings). The partition plate may be fixed or movable. However, the partition plate is smaller than the inner section of the air supply and exhaust main pipeline 201, and airflow channel of the air supply and exhaust main pipeline 201 will not be completely blocked. The above two configurations all play the role of reducing the air sucked by the unit air supply fan 104 of the drying unit from the unit air inlet 101 to the adjacent unit air outlets 113 of the same group of drying units.

More preferably, an air supply valve 102 is disposed between the unit air inlet 101 and the drying oven air inlet 108, and an air exhaust valve 114 is disposed between the unit air outlet 113 and the air outlet 109 of the drying oven. When the unit stops working, the air supply valve 102 and the air exhaust valve 114 are switched off to prevent unnecessary gas from entering the air supply and exhaust main pipeline 201, or the air volume adjustment of the drying unit is achieved by a combination of the air supply valve 102 and the air exhaust valve 114.

More preferably, in order to ensure that the gas is heated to required temperature of the drying unit process before being sent to the drying oven 107, the drying unit further comprises a heater 105. The heating manner of the heater 105 comprises but is not limited to electric heating, conduction oil heating, steam heating and heat pump heating. The heater 105 may be disposed on the positive air pressure side of the unit air supply fan 104 or on the negative air pressure side of the unit air supply fan 104.

More preferably, since the exhaust air concentration at the unit air outlet 113 of the last group of drying units is taken as the highest concentration point of the entire drying system, a single point on-line monitoring is performed at the highest exhaust air concentration point, that is, the unit exhaust port 113 of the last group of drying units is provided with a concentration detection device (not shown in the figure). In order that the enterprise can easily implement and monitor the entire production process, the air exhaust volume of the drying system is adjusted according to the exhaust air concentration so as to ensure that the exhaust air concentration is below the safety limit, and thus the situation of the entire dry system is safe as long as the situation of a point is safe, which completely eliminates explosion hazard of the production equipment.

More preferably, the balanced drying system comprises an air supply filter 213. The air supply filter 213 is disposed on the air supply and exhaust main pipeline 201 for filtering dust and water steam in the outside air to ensure the air enters the drying system is clean and dry, which effectively solves the problem of air supply cleanliness and humidity fluctuations, so that the system has a better drying effect.

In the balanced drying system described in this embodiment, based on actual needs, the connection between each node or port (e.g., unit air inlet 101, unit air outlet 113, drying oven air inlet 108, drying oven air outlet 109, etc.) may be directly connected or connected via an air pipe or an air pipe with a valve.

Figure 2:
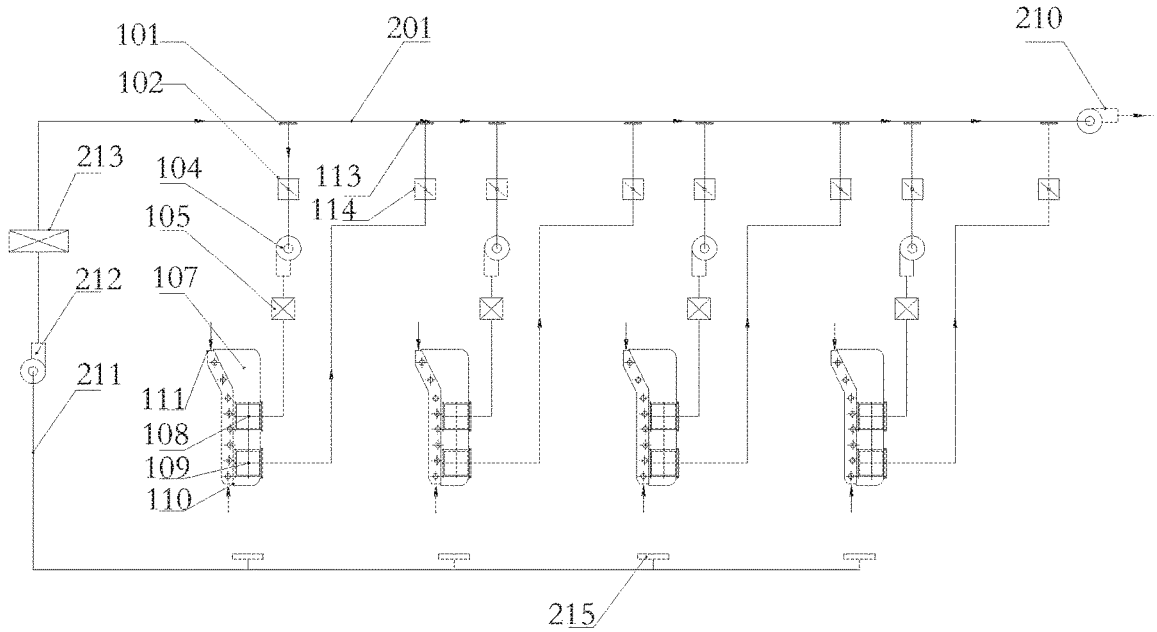
FIG. 2 is a schematic diagram of the balanced drying system when performing centralized air supply according to the present invention.

Embodiment 2 taking a gravure printing machine as an example, referring to FIG. 2, a description will be made on a balanced drying system that sucks air from the bottom of the printing unit for centralized air supply.

As in the balanced drying system described in the embodiment 1 and the modified embodiment 1, the air supply and exhaust main pipeline 201 simply and directly intakes the air from the external environment of the system. The embodiment 2 has a form of air intake that can deal with both exhaust air leakage and air exhaust from volatile solvent of the ink duct, that is, the air intakes is a centralized air supply. Based on the above embodiment 1, the balanced drying system further comprises an air supply fan 212 and at least two air collection slots 215, wherein the air supply end of the air supply and exhaust main pipeline 201 is provided with a plurality of air supply inlets each corresponding to one group of drying units, the air collection slots 215 are disposed at the air supply inlets and each is located under one of the drying ovens 107 correspondingly, and the air supply fan 212 and the air supply filter 213 are all arranged at the collection pipe section at one side of an air outlet of the air supply and exhaust main pipeline 201. The air exhaust end of the air supply and exhaust main pipeline 201 may also be connected with a heat exchanger for waste heat recovery. Thus, based on the optimal energy reservation of the balanced drying system, in order that solvent emission of the entire production equipment is organized, by taking advantage of the single air inlet structure of the balanced drying system, the air collection slots 215 are disposed below the printing unit (that is, below the drying oven 107), and the air outlets of the air collection slots 215 are connected in parallel with the air inlet of the exhaust air main pipe 201. In this way, when the drying system operates, the air containing trace amount of solvent steam near the printing unit is sucked into the drying system, so as to ensure normal drying function of the drying system and at the same time to achieve the exhaust ventilation of the production equipment by using the air exhaust device of the drying system, which not only simplifies the structure of the factory air exhaust system but also facilitates subsequent exhaust air treatment.

Figure 3:
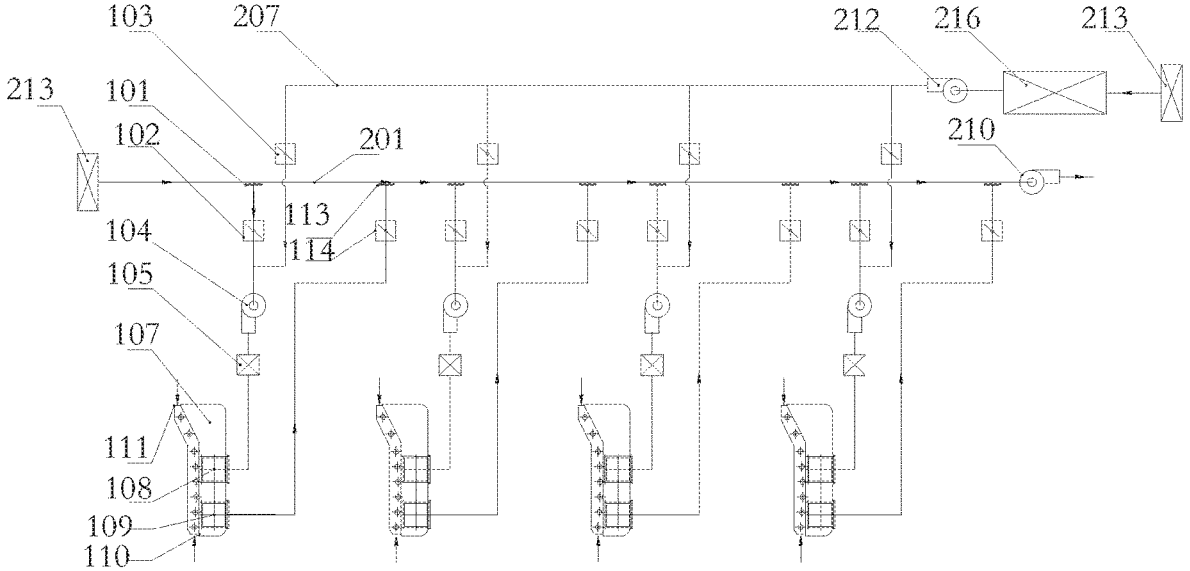
FIG. 3 is a schematic diagram of the balanced drying system when performing centralized heat supply according to the present invention.

Embodiment 3 taking a gravure printing machine as an example. Referring to FIG. 3, the centralized heating of the balanced drying system is described as follows:

Compared with embodiment 1, the main difference is that for the balanced drying system, a hot air main pipeline after being externally heated can be centralized for supplying hot air for several drying units. That is, based on the above embodiment 1, the balanced drying system further comprises a hot air main pipeline 207, an air supply fan 212, a hot air stove 216, an air supply filter 213 and at least two hot air valves 103. The hot air main pipeline 207 is provided with a plurality of hot air outlets connected in parallel and each corresponding to one group of drying units, the hot air outlets each is connected with the unit air inlet 101, the hot air valves 103 each is disposed between the hot air outlet and the unit air inlet 101, and the air supply fan 212, the hot air stove 216 and the air supply filter 213 are all arranged at the collection pipe section at one side of a hot air inlet of the hot air main pipeline 207. Therefore, the air inlet of the air supply valve 102 is connected with the outside air as a cold air inlet, and the air inlet of the hot air valve 103 is connected with the hot air main pipeline 207 as a hot air inlet. The ratio of the cold air and hot air are adjusted by the air inlet valve 102 and the hot air valve 103, then the cold air and hot air are mixed to achieve the required temperature of the drying process and are sent to the drying oven 107 through the unit air supply fan 104.

Wherein, the hot air stove 216 comprises, but is not limited to, a fuel gas hot air stove, a fuel oil hot air stove, a bio fuel hot air stove and a medium heat exchange heating hot air stove.

As described in embodiment 3, the unit air inlets 101 of the drying units of the balanced drying system are connected in parallel to the hot air main pipeline 207. The external heating device, including but not limited to the hot air stove 216, can select the most economical fuel or other more economical heat supply device according to the enterprise conditions. The part of air required by the drying system is warmed to a temperature above the process temperature, and it is mixed with part of the cool air at the air inlet 101 of the drying unit to reach the drying unit process temperature. In this way, the heater 105 of the drying unit can be omitted, other heat sources can be better utilized, and a more systematic plan for heating the entire plant can be made, which facilitates the use of clean energy.

More preferably, as an improvement of embodiment 3, air collection slots 215 may be provided below the printing unit (that is, below the drying oven 107). The specific arrangement can be made based on the solution as described in embodiment 2, so that the air intake can deal with exhaust air leakage and air exhaust from volatile solvent of the ink duct, that is, the air intakes is a centralized air supply. When the drying system of embodiment 3 is operated in this way, the air containing trace amount of solvent steam near the printing unit is sucked into the drying system, so as to ensure normal drying function of the drying system and at the same time to achieve the exhaust ventilation of the production equipment by using the air exhaust device of the drying system, which not only simplifies the structure of the factory air exhaust system but also facilitates subsequent exhaust air treatment.

In summary, the unit air inlet and the unit air outlet of the drying unit of the balanced drying system of the present invention are all connected with the air supply and exhaust main pipeline, so that the unit air inlets of the drying units are connected with the unit air outlets of the adjacent drying units via the air supply and exhaust main pipeline to form a series connection structure. The equipment pipeline is simplified, and the air pressure in the drying oven is automatically balanced in the air supply and exhaust main pipeline. The adjustment is simple, and the air volume required by the drying system is successively entered in each drying oven for drying and sweeping of the material to be dried. The air volume is adjusted according to the safe solvent concentration of the drying system. The unit air volume adjustment is simple and does not affect other units. The air and the contained heat are directly reused until the final drying unit is discharged from the drying system, and thus the heating energy consumption is reduced to a minimum level. In addition, the exhaust air emission volume determines the exhaust air volume to be subsequently treated. The balanced drying system makes the input and operating costs of subsequent exhaust air treatment significantly reduced. The exhaust air concentration at the air outlet of the last group of drying unit passed by the drying air of the system is the highest concentration point of the entire drying system. The single point online monitoring is implemented at the highest exhaust air concentration point, so that enterprises can easily implement the entire process control of production. The air exhaust volume of the drying system is adjusted according to the exhaust air concentration so as to ensure the exhaust air concentration is below the safety limit, and thus the situation of the entire dry system is safe as long as the situation of a point is safe, which completely eliminates explosion hazard of the production equipment. Therefore, the present invention has the advantages of a simple and stable system, simple adjustment, low air exhaust volume and thus low energy consumption, no safety hazards, low environmental protection cost and the like.

The balanced drying system of the present invention can improve the current development difficulties of high energy consumption, high cost of waste gas treatment and potential safety hazards faced by industries such as packaging printing and coating and painting, fundamentally reduce production costs, completely eliminates explosion hazard of the production equipment, and achieved complete energy conservation and emission reduction. In the current severe environmental protection dilemma, it completely solves the problem that the enterprise's market competitiveness is not strong or even affects the survival of enterprises. It opens a bright window for the development of packaging printing and coating and painting industries.

The above disclosed embodiments are merely preferred embodiments of the present invention, and certainly do not limit the scope of the present invention. Therefore, equivalent changes made according to the scope of the present invention for patent application still fall within the scope of the present invention.

What is claimed is:

1. A balanced drying system, characterized in that it comprises an air supply and exhaust main pipeline, an air exhaust fan and at least two groups of drying units;

the drying units each comprises a unit air supply fan and a drying oven, the drying units each is provided with a unit air inlet and a unit air outlet, the drying oven is provided with a drying oven air inlet and a drying oven air outlet, and all of the groups of the drying units are disposed in pairs at intervals on the air supply and exhaust main pipeline via the unit air inlet and the unit air outlet, the unit air inlet is connected with the drying oven air inlet, and the unit air outlet is connected with the drying oven air outlet;

one end of the air supply and exhaust main pipeline is an air exhaust end and is connected with the air exhaust fan, the other end of the air supply and exhaust main pipeline is an air supply end, the unit air inlet of a first group of drying units is adjacent to the air supply end provided at the air supply and exhaust main pipeline, the unit air outlet of a last group of the drying units is adjacent to the air exhaust end provided at the air supply and exhaust main pipeline, and among the two adjacent groups of drying units, the unit air outlet of a former group of drying units is connected with the unit air inlet of a latter group of drying units; and the unit air supply fan is disposed between the unit air inlet and the drying oven air inlet;

further comprising an air supply filter, the air supply filter being disposed at the air supply end of the air supply and exhaust main pipeline;

further comprising an air supply fan and at least two air collection slots, wherein the air supply end of the air supply and exhaust main pipeline is provided with a plurality of air supply inlets connected in parallel and each corresponding to one group of drying units, the air collection slots are disposed at the air supply inlets and each is located under one of the drying ovens correspondingly, each air collection slot comprises at least one air outlet, and the air outlets of the air collection slots are connected with the air supply and exhaust main pipeline, and the air supply fan and the air supply filter are all arranged at the collection pipe section at one side of an air outlet of the air supply and exhaust main pipeline.

2. The balanced drying system according to claim 1, characterized in that the distance between the unit air inlet and the unit air outlet of the group of drying units is greater than the distance between the adjacent two groups of drying units.

3. The balanced drying system according to claim 1, characterized in that a partition plate is provided in the air supply and exhaust main pipeline between the unit air inlet and the unit air outlet of the group of drying units.

4. The balanced drying system according to claim 1, characterized in that a valve is provided between the unit air outlet and the drying oven air outlet.

5. The balanced drying system according to claim 1, characterized in that a valve is provided between the unit air inlet and the drying oven air inlet.

6. The balanced drying system according to claim 1, characterized in that a concentration detection device is provided at the unit air outlet of the last group of drying units.

7. The balanced drying system according to claim 1, characterized in that the drying unit comprises a heater, the heater being disposed on a positive air pressure side or a negative air pressure side of the unit air supply fan.

* * * * *